United States Patent [19]

Focke et al.

[11] Patent Number: 4,559,757

[45] Date of Patent: Dec. 24, 1985

[54] CIGARETTE PACKAGING APPARATUS WITH TANGENTIAL TRANSFER

[75] Inventors: Heinz H. Focke; Kurt Liedtke, both of Verden, Fed. Rep. of Germany

[73] Assignee: Focke & Co., Verden, Fed. Rep. of Germany

[21] Appl. No.: 530,172

[22] Filed: Sep. 7, 1983

Related U.S. Application Data

[62] Division of Ser. No. 210,186, Nov. 25, 1980, Pat. No. 4,428,177.

[30] Foreign Application Priority Data

Dec. 7, 1979 [DE] Fed. Rep. of Germany ..... 2949252

[51] Int. Cl.[4] ..... B65B 19/22

[52] U.S. Cl. ..... 53/176; 53/234; 198/605; 198/478.1

[58] Field of Search ..... 53/148, 225, 234, 575, 53/176; 198/483, 605

[56] References Cited

U.S. PATENT DOCUMENTS

| | | | |
|---|---|---|---|
| 3,380,227 | 4/1968 | Youngman | 53/234 |
| 3,439,473 | 4/1969 | Focke | 53/234 |
| 3,818,675 | 6/1974 | Griner | 53/234 |
| 3,899,865 | 8/1975 | Revaz | 53/234 |
| 4,006,577 | 2/1977 | Schoppee | 53/234 X |

FOREIGN PATENT DOCUMENTS

| | | | |
|---|---|---|---|
| 1511585 | 9/1969 | Fed. Rep. of Germany | 53/234 |
| 2127706 | 12/1972 | Fed. Rep. of Germany | 53/234 |
| 600690 | 12/1957 | Italy | 53/234 |
| 172672 | 8/1965 | U.S.S.R. | 53/234 |

*Primary Examiner*—John Sipos

*Attorney, Agent, or Firm*—Sughrue, Mion, Zinn, Macpeak and Seas

[57] ABSTRACT

An apparatus for packaging cigarettes includes a magazine 35 for supplying cigarette groups 23 to pockets 71 of a first revolver 66, whereafter they are transferred into foil lined pockets 74 of a second revolver 67 and then into paper lined pockets 91 of a third revolver 68. The revolvers are continuously driven, and the groups are always oriented with their wide front or rear faces outermost in the pockets to implement smooth tangential transfer between the revolvers. A curved stripper and guide bar 94 enters through the sides of the first revolver pockets to transfer the groups to the second revolver. Transfer between the second and third revolvers is made by simultaneously decreasing the radial depth of the second revolver pockets and increasing the radial depth of the third revolver pockets at a transfer station 89.

5 Claims, 11 Drawing Figures

CIGARETTE PACKAGING APPARATUS WITH TANGENTIAL TRANSFER

Figure 1:
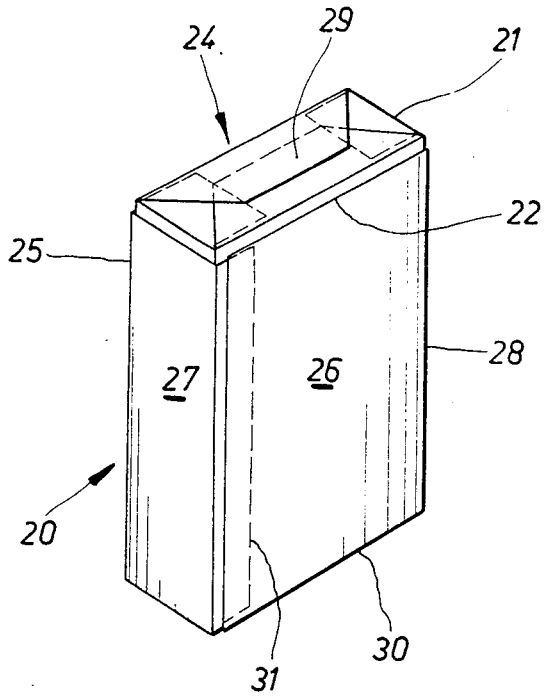

This is a division of application Ser. No. 210,186, filed Nov. 25, 1980, now U.S. Pat. No. 4,428,177.

DESCRIPTION

The invention relates to processes and apparatus for packing cigarettes or similar bar-shaped objects into a quadratic pack with at least one inner wrapper (tin-foil blank) and one pack wrapper (paper blank), the cigarettes being extracted in groups, according to the pack content, from a magazine or the like and passing, as cigarette group or as tin-foil block, through several successive conveying devices in which folding of the blanks is effected.

Packing machines for the production of cigarette packs are frequently equipped with several successive rotary conveying devices which accommodate the cigarette groups or packs in pockets. The conveying devices, especially rotary dial feeds, are each provided with folding devices which effect folding of the blanks during the rotation of the packs or part packs. The cigarette groups or part packs are transferred from one dial feed to the next in the region of their smallest spacings from one another.

Practical requirements demand packing machines with ever higher outputs, that is to say quantities produced, per unit of time. Against this, there is the necessity for a careful treatment of the pack content, namely the cigarettes. These are extremely sensitive to shock loads, strong acceleration and other mechanical influences.

With this as a starting point, the object of the invention is to propose a packing process and a packing machine with which especially cigarettes can be handled carefully at a higher output of the packing machine.

To achieve this object, the process according to the invention consists in that the cigarette groups and/or the tin-foil blocks are transferable from one conveying device to the other, with their large faces pointing in the transport direction.

Alternatively, the object is achieved, according to the invention, due to the fact that the cigarette groups and/or tin-foil blocks which pass through successive rotary conveying devices (dial feeds or pocket chains guided via guide sprocket wheels) are transferable from one conveying device to the next in a tangential direction (direction of rotation of the conveying devices).

The abovementioned processes are based on a common principle. This is to transfer the cigarette groups or the part packs, especially cigarette groups encased in the tin-foil blank, from one conveying device to the next over the shortest possible transport distance. According to the findings of the invention, this is possible, on the one hand, due to the fact that the quadratic objects (cigarette groups or tin-foil blocks) are pushed out of the pocket of one conveying device and into the directly adjacent pocket of the next following conveying device, with their large faces (front side or rear side) pointing in the transport direction. The stroke to be executed in so doing is determined by the width of the narrow side faces of the quadratic object.

Alternatively, it is provided that the objects are conveyed continuously (by dial feeds or pocket chains) and, without appreciable displacement in a radial direction, that is to say merely by transport in the peripheral direction of the conveying devices, are carried from one conveying device to the other.

According to the invention, two basic solutions are possible also in the case of the apparatus for carrying out the process.

In the case of a construction working in timed operation, several dial feeds with stepwise rotation are provided, with pockets to accommodate the cigarette groups, tin-foil blocks or the like. The pockets are arranged so that the objects accommodated therein point with their large limiting faces inwards and outwards respectively, looking in a radial direction. By means of a radially movable slide the objects are pushed out of the pocket of one dial feed into the pocket of the next. Upon the transfer of the object, there is already located in this next dial feed a preformed blank which is then folded round the object as the cycle proceeds.

In the case of a preferably continuously operating construction of the packing machine, several uniformly rotating conveying devices, namely dial feeds, are provided, whose pockets are formed intermittently by means of a radial movement of the lateral limitations and are then eliminated again. It is thereby possible that the objects can be transferred from one dial feed to the next without displacement in a radial direction. During the oppositely directed rotation of the adjacent dial feed, the pocket is formed on the one side with simultaneous elimination of the pockets on the opposite side. During this operation the objects are held in position by a supporting device (stationary guide bars) acting in a radial direction.

The processes and apparatus according to the invention are especially advantageous for the production of so-called soft cigarette packs, that is to say for packs in which the respective blanks—also the paper blank—are relatively thin-walled and are thus easily malleable.

Further features of the processes and apparatus according to the invention are the subject of sub-claims.

Figure 2:
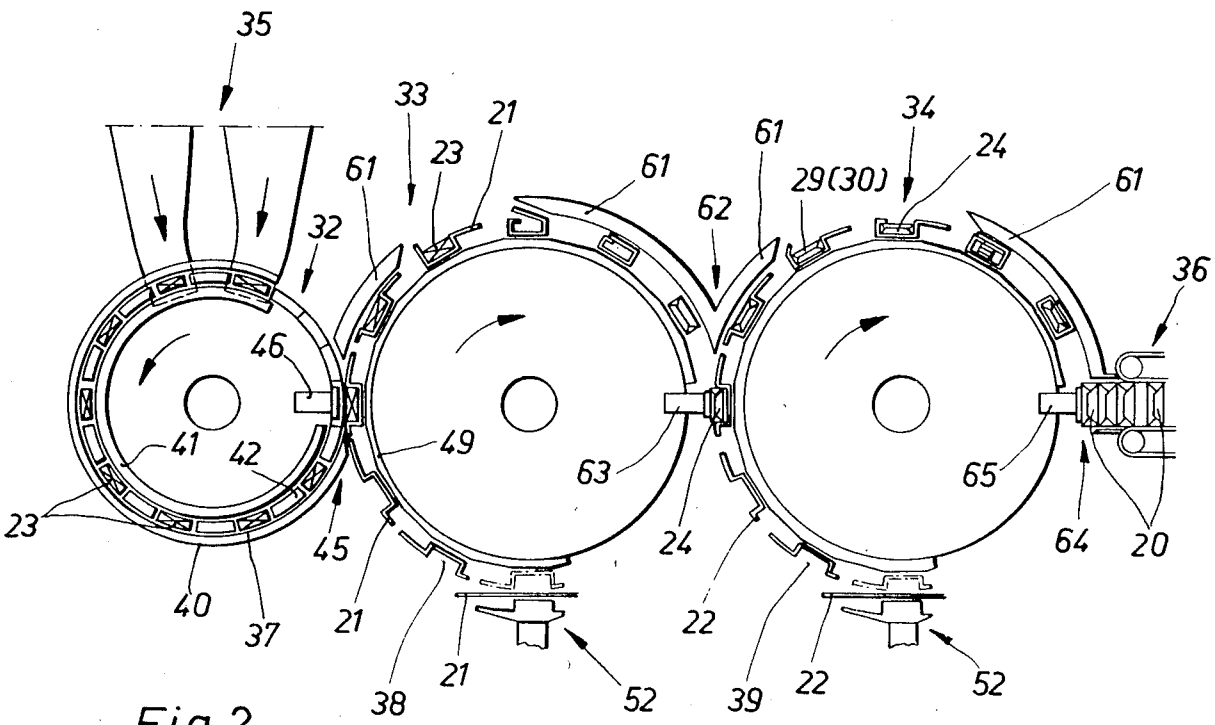
Figure 3:
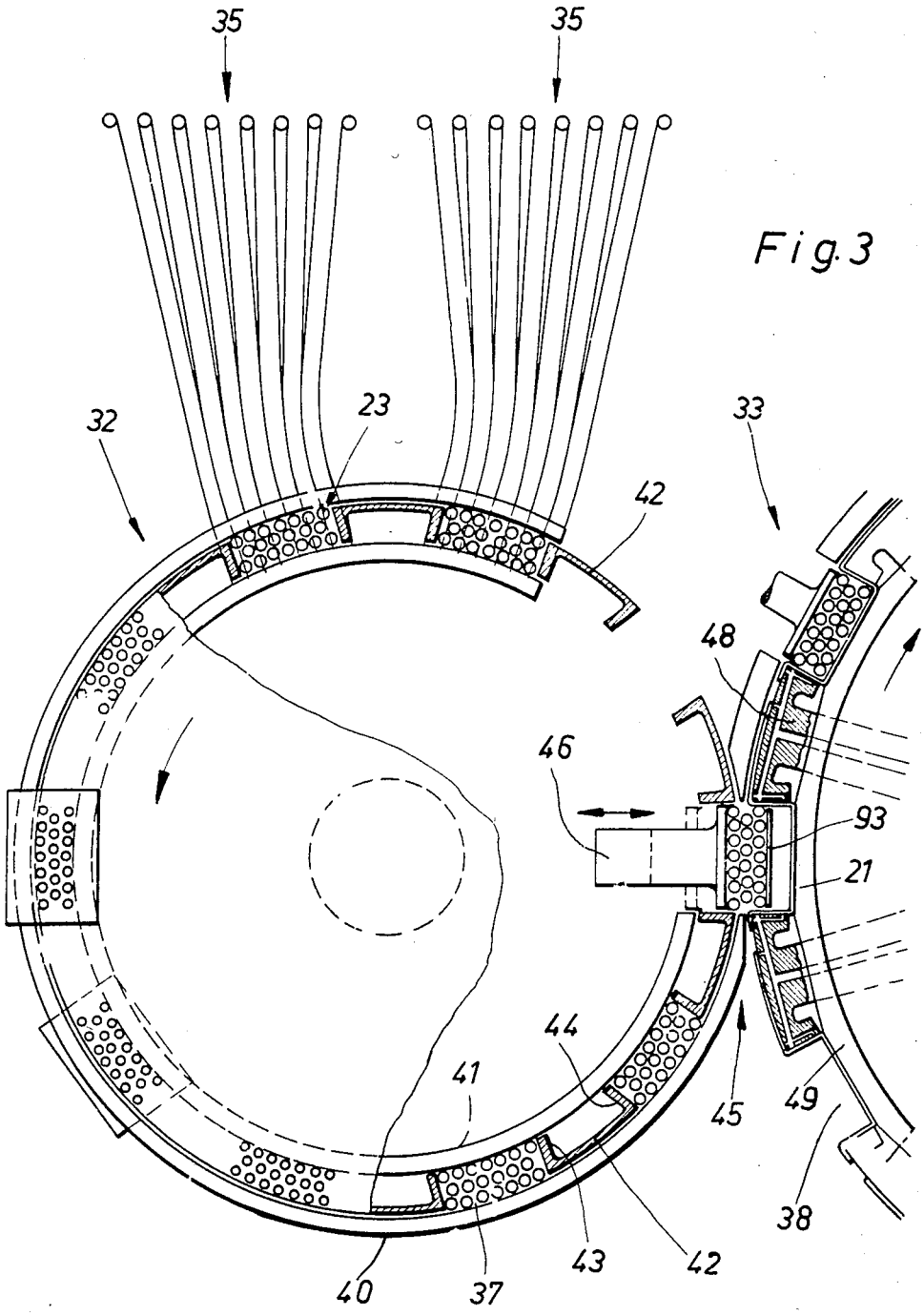
Figure 4:
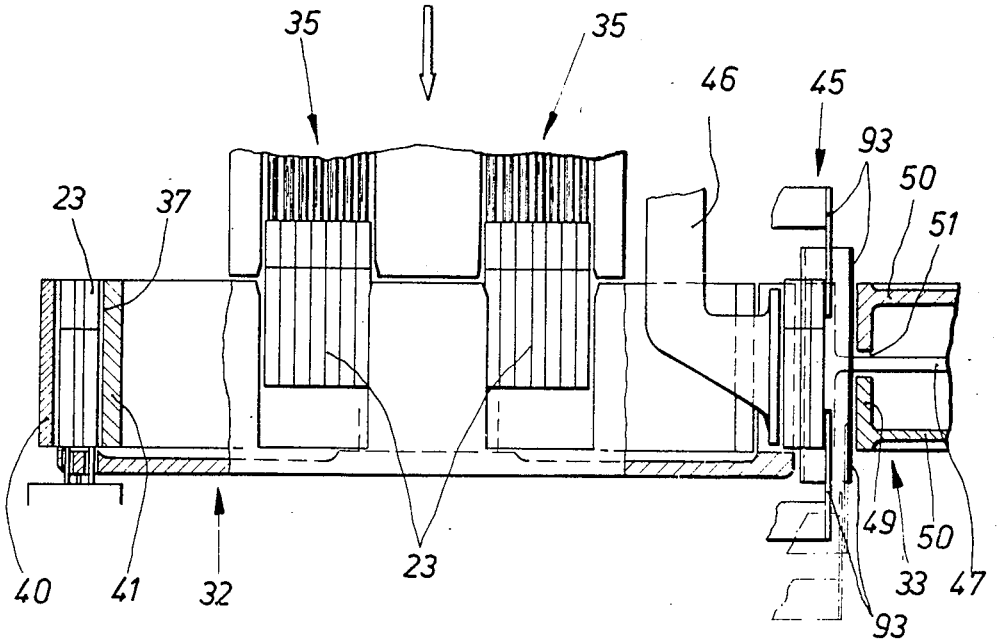
Figure 5:
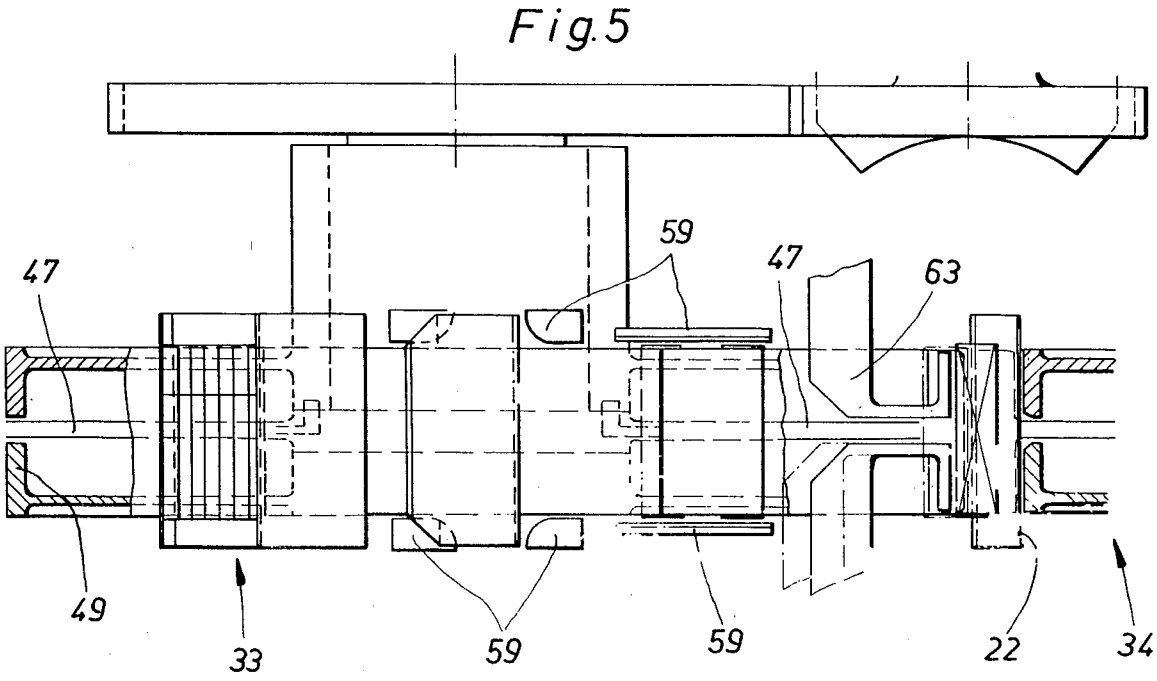
Figure 6:
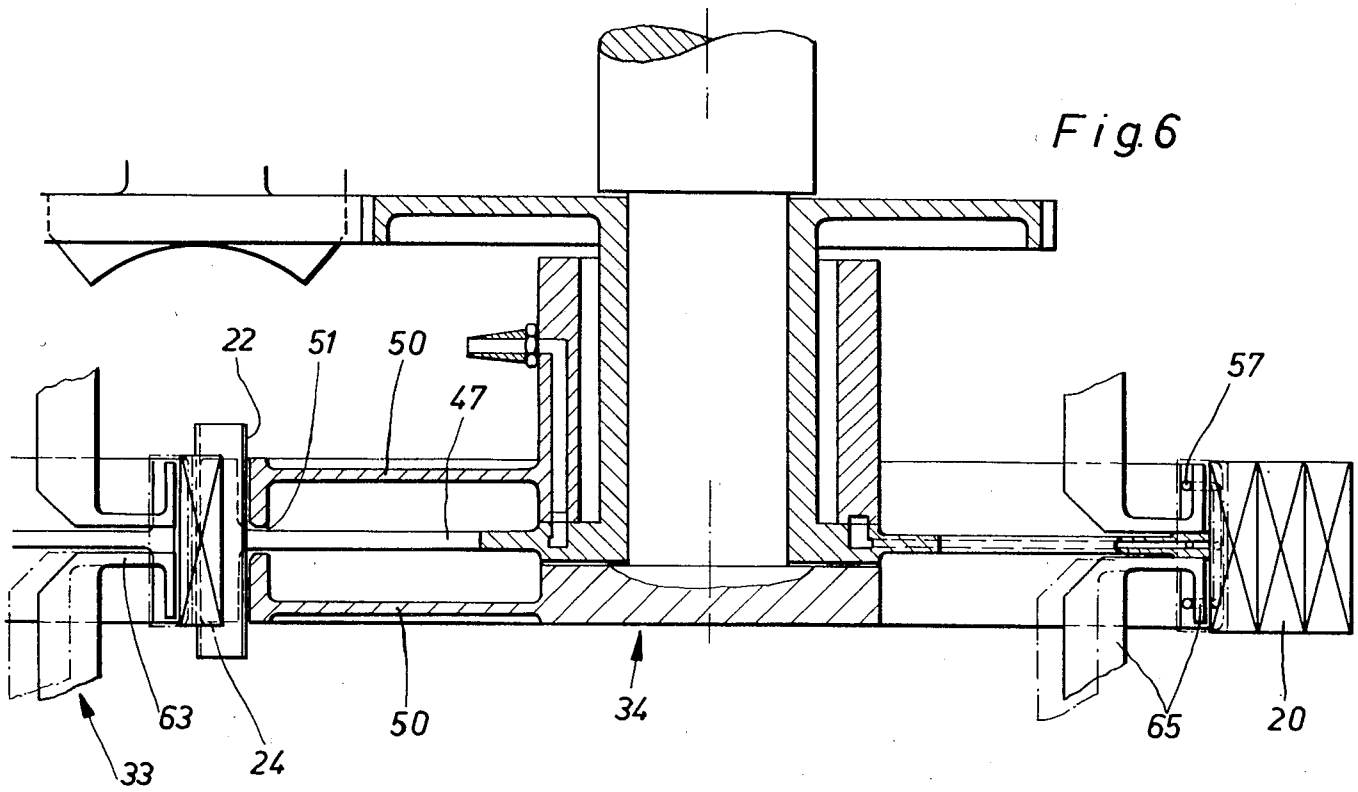
Figure 7:
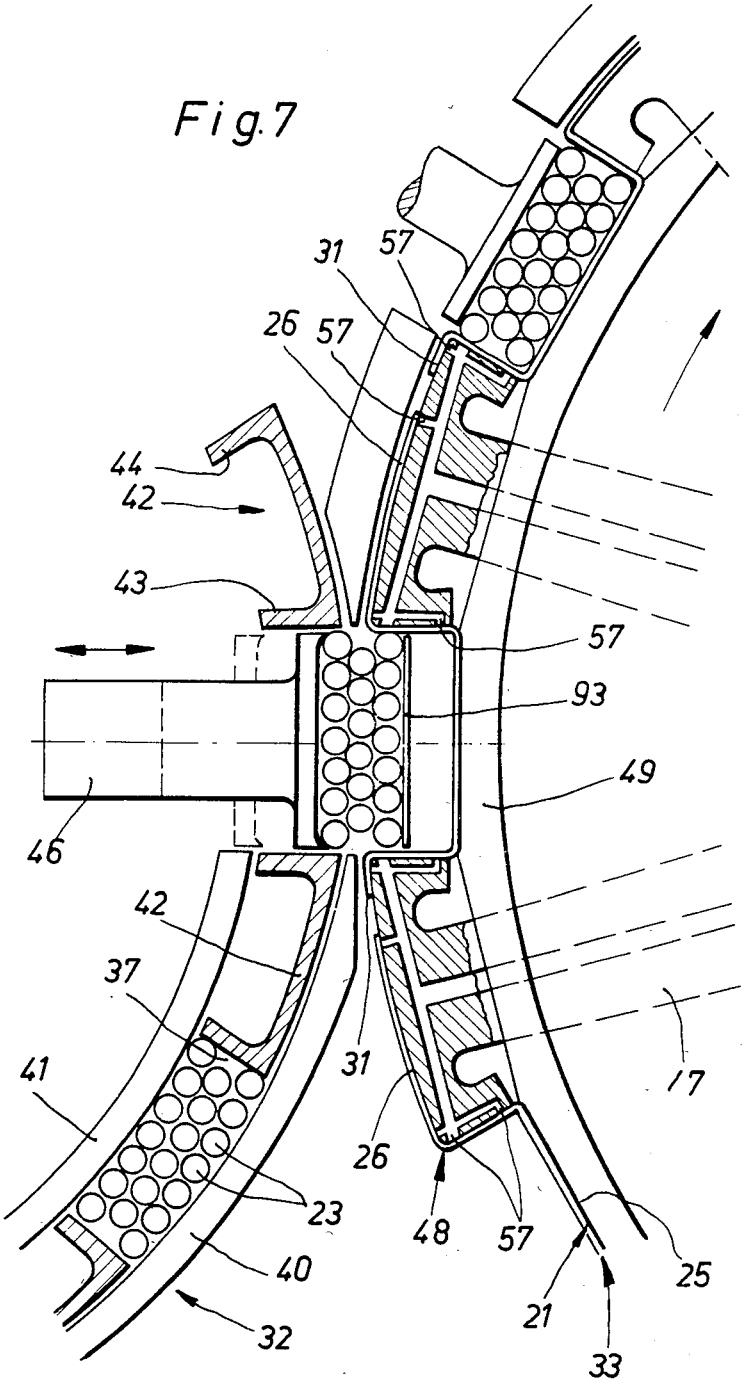
Figure 8:
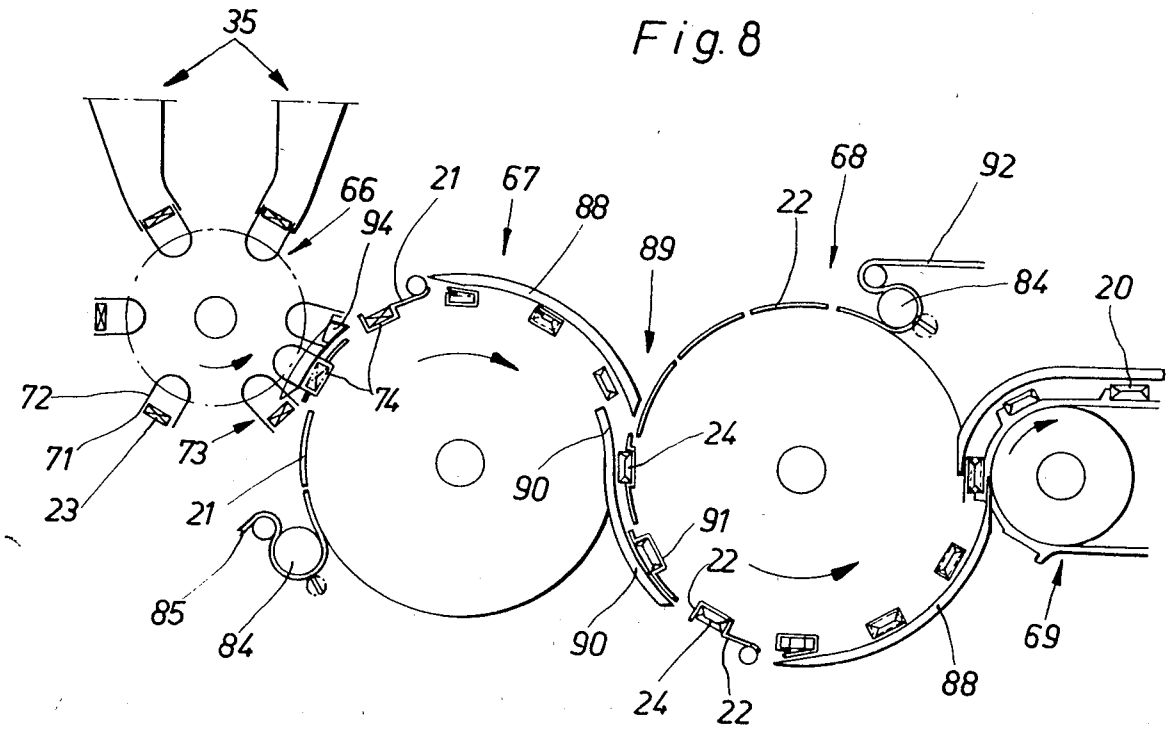
Figure 9:
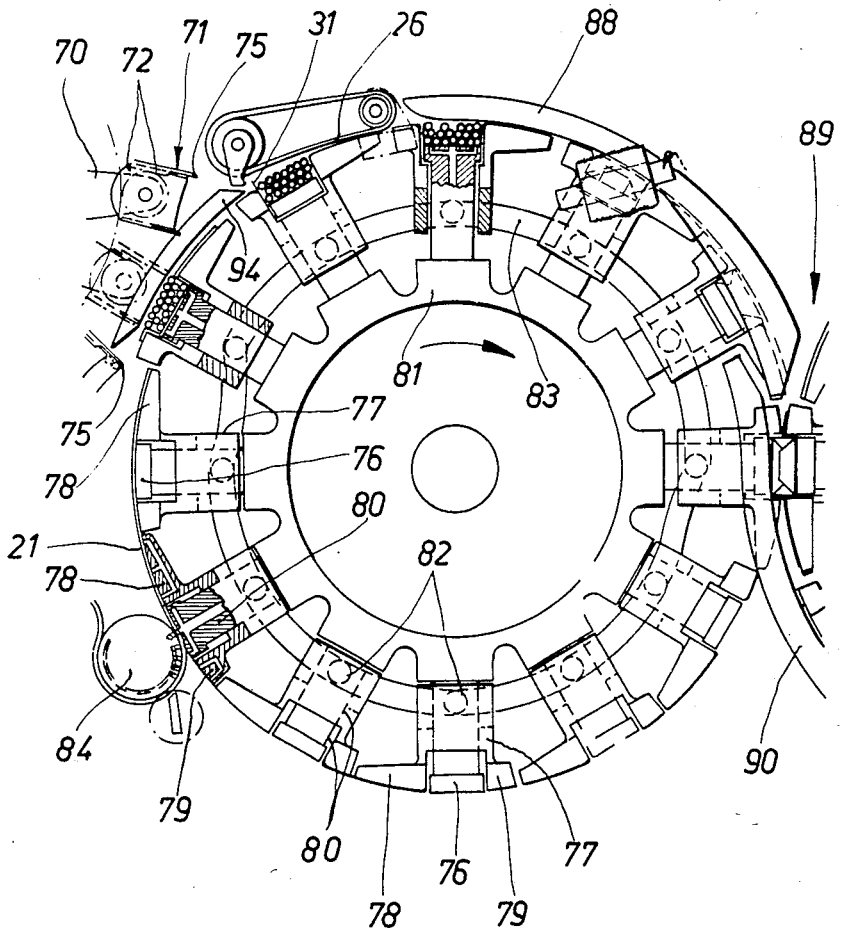
Figure 10:
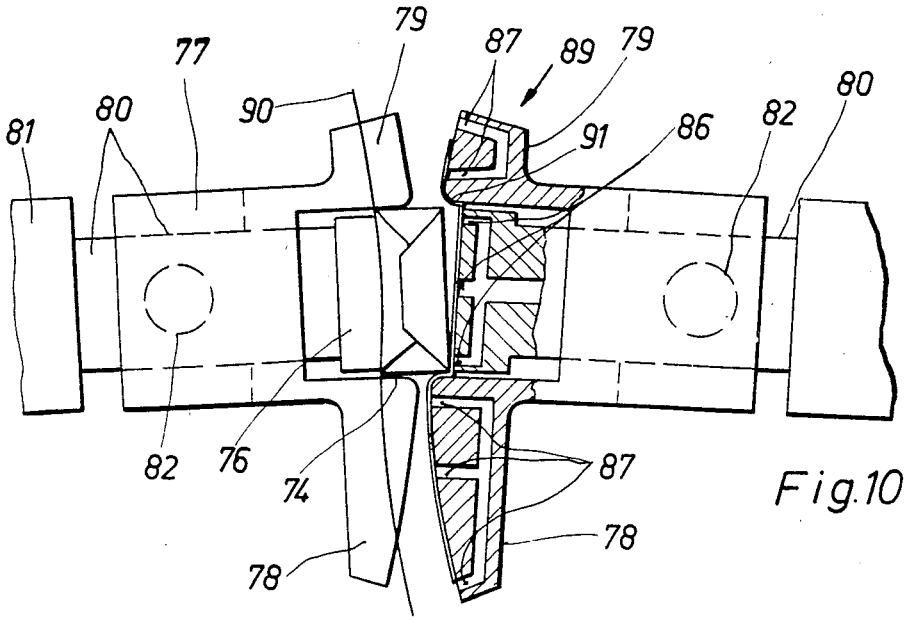
Figure 11:
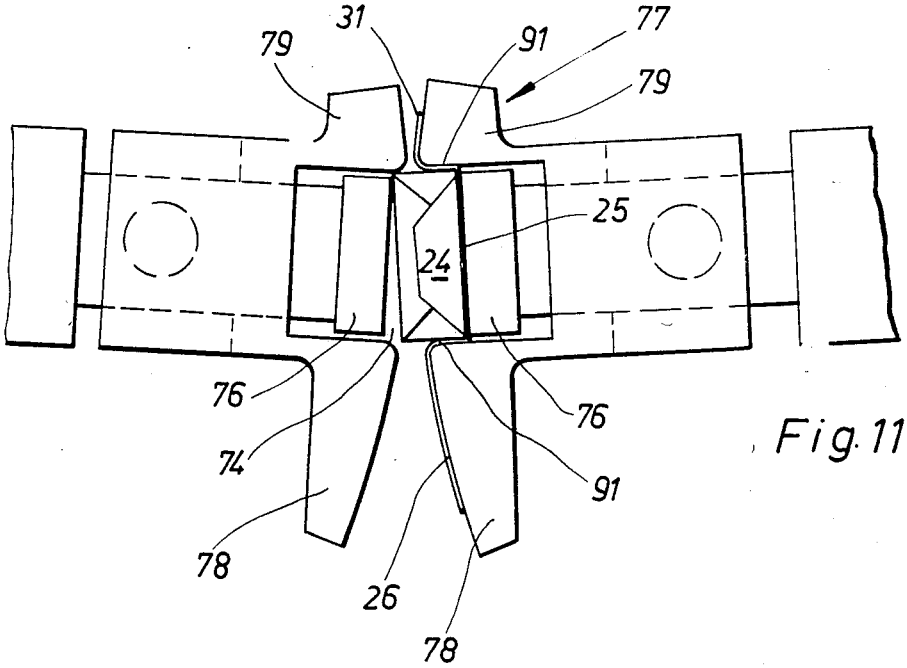

Exemplary embodiments of packing machines are described in more detail below with reference to the drawings wherein:

FIG. 1 is a perspective view of a quadratic pack, namely a soft pack, for cigarettes, FIG. 2 is a vertical section or schematic side view of a first embodiment of the apparatus, FIG. 3 is a vertical section or side view, on an enlarged scale, of a magazine dial feed of the apparatus according to FIG. 2, FIG. 4 is a horizontal section of the magazine dial feed according to FIG. 3, FIG. 5 is a horizontal section or plan view of a first folding dial feed of the apparatus according to FIG. 2, FIG. 6 is an illustration corresponding to FIG. 5 of a second folding dial feed of the apparatus according to FIG. 2, FIG. 7 shows a section of the magazine dial feed on a scale enlarged again, FIG. 8 is an illustration, analogous to FIG. 1, of a second embodiment of the apparatus, FIG. 9 shows a part of a first folding dial feed of the apparatus according to FIG. 8, on an enlarged scale, FIGS. 10 and 11 show a detail in the region of the transfer of objects from the first folding dial feed to the second, in two positions, on a scale enlarged again.

The exemplary embodiments of packing machines illustrated in the drawings are suitable preferably for the production of soft packs 20. This consists of an inner wrapper, namely a tin-foil blank 21, and of an outer casing, namely a paper blank 22. The tin-foil blank 21 encases on all sides a cigarette group 23 arranged in a quadratic formation and constitutes therewith a quadratic tin-foil block 24. This is encased, in turn, by the cup-shaped, hence upwardly open paper blank 22.

The pack thus designed forms relatively large-area front and rear sides 25 and 26 respectively, relatively narrow side faces 27 and 28 and end faces 29 and 30 having equal widths.

In the present case, the tin-foil blank 21 and, correspondingly, the paper blank 22 are laid around the cigarette group 23 or the tin-foil block 24 according to the "cross-wrapping process" to form a tube in an intermediate folding position. In so doing, a marginal flap 31 which is shown in FIG. 1 with reference to the paper blank 22 is joined to the rear side 26 of the paper blank 22. The blank parts which, in the abovementioned intermediate folding position, project on both sides (tin-boil blank 21) or in the region of the bottom (paper blank 22) are subsequently folded into the plane of the end faces 29 and 30.

Apparatus to produce packs with the exemplary features of FIG. 1 is illustrated in two embodiments in the drawings. The apparatus according to FIGS. 2 to 7 is designed so as to be considered pre-eminently for a discontinuous, that is to say timed cycle of movement. The embodiment according to FIGS. 8 to 11 is, on the other hand, especially suitable for a continuous work cycle.

In the embodiment of FIGS. 2 to 7, three endless rotary conveying devices are provided in series and adjoining one another for receiving and processing the packs. These are a first dial feed, namely a cigarette dial feed 32, followed by a tin-foil dial feed 33 and, finally, a paper dial feed 34. The cigarette dial feed 32 serves to receive the cigarette groups 23 from a cigarette magazine 35 whose lower discharge shafts are illustrated in FIG. 2.

In the tin-foil dial feed 33 the cigarette groups 23 are provided with the inner blank (tin-foil blank 21). The following paper dial feed 34 encases the tin-foil blocks 24 in the paper blank 22. The soft packs 20, finished with the exception of an outer cellophane wrapper, leave the paper dial feed 34 for a discharge conveyor 36.

An especial feature is the relative position of the cigarette groups 23 or tin-foil blocks 24 within the dial feeds 32, 33, 34 and in the transport direction, above all during the transfer from one dial feed to the next. The cigarette groups 23 and tin-foil blocks 24 are arranged so that they are transferred over the shortest distance from one dial feed to the next, namely with the direction of movement parallel to the narrow dimensions of the side faces 27, 28. In so doing, the front side 25 and rear side 26 are located at the front and at the rear respectively in the transport direction. Since the dial feeds 32, 33, 34 adjoin one another directly with their outer limitations or surfaces, the radially directed stroke of the cigarette groups 23 or tin-foil blocks 24 amounts merely to a distance corresponding to the width of the side faces 27, 28. Correspondingly short station times can thereby be adhered to. The cigarette groups 23 or tin-foil blocks 24 are accommodated in the pockets 37 or 38 or 39 of the dial feeds 32, 33, 34 with the cigarettes pointing in the axial direction of the dial feeds 32, 33, 34 and with the (large) front and rear sides 25, 26 lying in the peripheral plane or tangentially, but in any case transversely to the radial direction.

Since it has to move small masses, the cigarette dial feed 32 is designed specially in this embodiment. It consists of an outer circular outside wall 40 and of a correspondingly designed inside wall 41 arranged concentrically thereto. These are stationary, that is to say non-turnable, and limit the pockets 37 for accommodating a cigarette group 23 on the radially outer and inner sides. The outside wall 40 and inside wall 41 form an annular gap which extends over a part periphery of the cigarette dial feed 32 and within which travel the pockets 37 with the cigarette groups 23 (in timed operation).

In the present case, there are provided, to limit the pockets 37 laterally, U-shaped intermediate pieces 42 which have a spacing from one another corresponding to the width of the pockets 37. The intermediate pieces 42 are moved together, in timed operation, in a peripheral direction between the outside wall 40 and inside wall 41, thereby carrying along the cigarette groups 23. The pockets 37 are limited by the legs 43, 44 of the intermediate piece 42 as side faces.

The outside wall 40 and inside wall 41 are interrupted in the region of a transfer station 45 between the cigarette dial feed 32 and the following tin-foil dial feed 33—approximately at the height of a continuous central horizontal plane. An ejector 46 movable from the inside of the cigarette dial feed 32 can thereby grip the cigarette group 23 in the respective pocket 37, in the region of the larger limiting face (corresponding to the front side 25 or rear side 26), and push same via a short stroke into an adjacent pocket 38 of the tin-foil dial feed 33.

Since the outside wall 40 ends before the transfer station 45 for the cigarette group 23, the cigarettes are exposed in this region on the radially outward side. In order, nevertheless, to ensure that the cigarette group 23 is held together, there is provided in this region a supporting device, in the form of two supporting plates 93, which bears against the cigarette group 23 on the outside. These supporting plates are provided with means for moving them in radial and axial directions. The plates move in a radial direction, together with the cigarette group 23, into the pocket 38 of the tin-foil dial feed 33. Approximately upon contact with the radially inward side of the pocket 38 or with the tin-foil blank 21, the supporting plates 93 are withdrawn by corresponding movement in an axial direction (FIG. 3, FIG. 4), so that the cigarettes thus come in direct contact with the tin-foil blank 21.

The tin-foil dial feed 33, also, is designed in a special way for reasons of efficiency. Intermediate segments 48 lying on the outside are arranged on radially directed supporting arms 47. These intermediate segments form lateral limitations for the pockets 38. A radially inward limitation of the pockets 38 is formed by a common annular support body 49 which is arranged in a stationary manner and which extends over a part region of the paper dial feed 34. The support body 49 is held by outer and lateral supporting walls 50, between which revolve the supporting arms 47 with the intermediate segments 48. For this purpose, the support body 49 is provided with a central continuous slit 51 through which the supporting arms 47 project.

The pockets 38 which are U-shaped in cross-section are accordingly formed by the stationary support body 49 and the trapezoidal intermediate segments 48 which constitute the lateral limitations of the pockets 38 in a peripheral direction. These travel together with the intermediate segments 48 which are moved on (in timed operation), thereby carrying the cigarette groups 23 accommodated in the pockets 38 along in the peripheral direction of the tin-foil dial feed 33.

Before a cigarette group 23 is received in a pocket 38, a tin-foil blank 21 is introduced therein, in the present embodiment by means of a specially designed blank ram 52. This is constructed with a centre part 53 which, while carrying along the tin-foil blank 21, enters the pocket 38 located at any given time in the receiving position. In so doing, the tin-foil blank 21 is made U-shaped upon contact with the limiting faces of the pocket 38. Laterally projecting pressure pieces 54 and 55 of the blank ram 52 serve to apply laterally projecting parts of the tin-foil blank 21 (marginal flap and rear side) onto the intermediate segments 48 which limit the pocket 38. In this way, the tin-foil blank 21, with a part to form the front side 25 and the side faces 27, 28, is accommodated in the respective pocket 38, while the rear side 26 and a marginal flap 31 are kept ready on both sides of the pocket 38 on the outer face of the intermediate segments 48.

To fix the tin-foil blank 21 in the respective relative positions, the blank ram 52, namely its centre part, and the intermediate segments 48 are provided with suction perforations 57—also in the region of the lateral limitations of the pockets 38—which are connected to a vacuum source.

The cigarette group 23 introduced into a pocket 38 kept ready is, as illustrated, limited in the pocket 38 by a radially inward larger face of the tin-foil blank 21 (front or rear sides 25 or 26) and by the side faces 27, 28. With further movement of the dial feed, there follow folding devices 58, 59 and 60 with which the further folding is effected, namely first the folding over of the blank parts lying on the intermediate segments 48 in a peripheral direction (folding device 58) and then the blank parts projecting laterally (in the axial direction of the dial feed) (folding devices 59, 60). The content of the pockets 38, namely first the cigarette groups 23 and then the partly finished tin-foil block 24, is held in the radially and axially outwardly open pockets 38 by outer stationary supporting bars 61 along which the content of the pockets 38 slides.

The transfer of the ready-folded tin-foil blocks 24 from the tin-foil dial feed 33 to the paper dial feed 34 is effected in a way corresponding to that in the region of the transfer station 45. At this transfer station 62, also, the dial feeds 33 and 34 which rotate in the same direction adjoin one another directly with their surfaces. A slide 63 movable in a radial direction transfers the tin-foil blocks 24, with a short stroke corresponding to the width of the side faces 27, 28, into a pocket 39 of the paper dial feed 34 or into a paper blank 22 fixed therein. The transport direction is such that the large faces (front side 25, rear side 26) lie at the front and rear in the transport direction. The tin-foil block 24 is accommodated correspondingly in the paper dial feed 34, with the abovementioned faces pointing in a peripheral direction.

In other respects, the paper dial feed 34 is designed in the same way as the tin-foil dial feed 33. Corresponding parts therefore bear the same reference numerals. Also assigned to this paper dial feed 34 are folding devices which effect the folding of the paper blank 22 in the way described.

Provided on the side of the paper dial feed 34 lying opposite the transfer station 62 is a discharge station 64 with an ejector 65 which pushes the finished packs 20 into the discharge conveyor 36.

The apparatus according to FIGS. 8 to 10 which is designed primarily for a continuous cycle of movement is basically constructed analogously to the apparatus described above. A cigarette dial feed 66 is followed by a tin-foil dial feed 67 and paper dial feed 68. The soft packs 20 are removed (continuously) from the latter by means of a discharge conveyor 69.

In the present case, the cigarette dial feed 66 consists of a plurality of pockets 71 which are each arranged on a holding arm 70 and in each of which a cigarette group 23 is accommodated after extraction from the cigarette magazine 35. The pockets 71 are arranged on special pocket holders 72 which are, in turn, attached movably, in the present case pivotably, to the ends of the holding arms 70. The movement of the pocket holders 72 and, consequently, of the pockets 71 is controlled in such a way that, as the onward movement continues, namely turning of the holding arms 70, the pockets 71 are stopped momentarily, namely in the region of the outlet shafts of the cigarette magazine 35, in order to receive a cigarette group 23.

In the same way, the transfer of cigarette group 23 is effected from the cigarette dial feed 66 to the tin-foil dial feed 67. Here, by a correspondingly controlled movement of the pocket holder 72, a momentary synchronism of the pockets 71 of the cigarette dial feed 66 with pockets 74 of the tin-foil dial feed 67 is brought about in the region of a transfer station 73. The transfer of the cigarette group 23 to the pocket 74 is effected during this synchronous phase.

In the embodiment illustrated, the pockets 71 of the cigarette dial feed 66 are largely open on the radially outward side. The cigarette group 23 is held merely by inwardly directed bends 75 of the outer margins of the pockets 71. It is thereby possible, by means of a transfer bar 94 penetrating into the central region of the pockets 71, to convey the cigarette group 23 out of the pocket 71 and into the pocket 74, namely as a result of the diverging paths of movement of the pockets 71 and 74.

The tin-foil dial feed 67 and paper dial feed 68 are designed in a special way. The pockets 74 consist of two parts movable relative to one another, namely a bottom part 76 and a side part 77. The latter extends, with segment parts 78 and 79, on both sides of the bottom part 76.

Here, the bottom part 76 is designed as the end of a radially directed arm 80 in each case. The arms 80, in turn, are arranged in a star-shaped or radiate formation on a rotating wheel 81. The arms 80 also serve, at the same time, as carrier and guide for the side parts 77. A side part 77 enclosing the arm 80 is mounted displaceably on each arm 80 to slide in a radial direction. The side parts 77 are each movable in a radial direction relative to the bottom part 76, so that in an outwardly directed extreme position of the side parts 77 these constitute a lateral limitation of the pockets 74. In the withdrawn position the side parts 77 or their segment parts 78 and 79 lie in the same (peripheral) plane as the bottom parts 76. The movement of the side parts 77 is controlled by runners 82 arranged thereon which enter a curved track 83.

The tin-foil blanks 21 are fed to the tin-foil dial feed 67 from outside by means of a transfer roller 84, namely after previously being detached from a sheet 85 of packing material. The tin-foil blanks 21 are applied onto the outer periphery, that is to say onto the surface, of the tin-foil dial feed 67. By means of the side parts 77 which are withdrawn in this region, there is formed by their segment parts 78, 79, together with the bottom parts 76, a substantially continuous closed surface of the tin-foil dial feed 67, onto which the tin-foil blanks 21 are applied.

In this position the tin-foil blanks 21 are conveyed substantially in direct succession and are held by means of suction perforations 86 and 87 in the bottom part 76 and in the side parts 77 (segment parts 78, 79).

In the region of the transfer station 73 the side parts 77 are moved radially outwards as the turning movement of the tin-foil dial feed 67 continues. The pocket 74 is thereby provided with increasing depth in a radial direction. At the same time, the cigarette group 23 is fed to the tin-foil dial feed 67 or the respective pocket 74, with contact on the bottom part 76. The side parts 77 increasingly enclose the fed cigarette group 23 laterally by means of the outwardly moved segment parts 78, 79.

Due to this radial movement of the side part 77, the tin-foil blank 21 is simultaneously folded in a U-shaped manner in this region, specifically with corresponding partial encasing of the cigarette group 23. After the cigarette group 23 has been accommodated completely in the pocket 74 or in the correspondingly shaped tin-foil blank 21, a wide and a narrow flap (rear side and marginal flap) remain in contact with the segment parts 78 and 79. A partial folding of the tin-foil blank 21 is thus provided, analogously to the embodiment of FIGS. 2 to 7. During the above-described relative movement of the bottom part 76 and side part 77 and during the U-shaped folding of a part of the tin-foil blank 21 which is caused thereby, said tin-foil blank is held (additionally) by means of the suction perforations 86 of the bottom part 76 and is, at the same time, slipped off from the suction perforations 87 of the segment parts 78, 79.

Adjoining the transfer station 73 there follow folding devices which can be designed in the same way as or similarly to those of the preceding embodiment.

The cigarette groups 23 or the tin-foil block 24 are fixed in the outwardly open pockets 74 of the tin-foil dial feed 67 in a part region by an outer stationary arcuate holding bar 88. This ends in the region of a transfer station 89 between the tin-foil dial feed 67 and the paper dial feed 68.

The holding bar 88 of the tin-foil dial feed 67 is followed, with overlapping, by a transfer and holding bar 90 which is assigned to the paper dial feed 68. Said transfer and holding bar 90 effects the transfer of the tin-foil block 24 from the pockets 74 of the tin-foil dial feed 67 to the pockets 91 of the paper dial feed 68.

This transfer operation takes place in a special way, as may be seen from the detail according to FIGS. 10 and 11. There occurs, in so doing, no movement or only a slight movement of the tin foil block 24 in a radial direction. The path of movement during the transfer is, rather, tangential or arcuate, namely directed in the peripheral direction first of the one dial feed and then of the following one.

The movement of the two dial feeds 67, 68 is controlled so that, with an opposing direction of rotation, any two pockets 74 and 91 meet one another in the region of the transfer station 89 and are momentarily in synchronism with one another. The transfer is effected so that, in the further cycle of movement, the side part 77 of the pocket 74 is moved back radially inwards and the side part 77 of the following paper dial feed 68 is moved correspondingly radially outwards and, in so doing, receives the object, in the present case the tin-foil block 24.

During this transfer of the tin-foil block 24, the U-shaped folding of the paper blank 22 is effected simultaneously due to the relative movement of the bottom part 76 and side part 77. Here, also, the suction perforations 86 and 87 present in an analogous way take effect once again. The positions shown in FIGS. 10 and 11 reveal that the block-shaped object (tin-foil block 24) to be transferred is always gripped laterally, also, by the diminishing pocket 74 or by the growing pocket 91.

The paper dial feed 68 is, accordingly, designed in the same way as the tin-foil dial feed 67, especially with regard to the formation and mode of operation of the pockets 91. In particular, the paper blanks 22 are also detached from a sheet 92 and are fed to the paper dial feed 68 in the way described in respect of the tin-foil dial feed 67. The folding operations, with encasing of the tin-foil block 24, also take place in a corresponding way. The transfer and holding bar 90 holds the tin-foil block 24 in the pocket 91 or in the partly folded paper blank 22 during a transport stage. There then follow folding devices of a suitable type and, finally, a holding bar 88 already described.

At the height of the transfer station 89, but on the opposite side of the paper dial feed 68, the finished packs 20 are transferred, likewise in a continuous tangential or peripheral movement, to a continuously rotating discharge conveyor 69.

This embodiment is characterised by the continuous uniform cycle of movement of the packs or blocks along exclusively curved paths of movement which adjoin one another without discontinuity.

We claim:

1. An apparatus for packaging rod-shaped objects such as cigarettes into quadratic packs having relatively wide width front and rear faces and relatively narrow width side and end faces, comprising:

(a) first, second and third continuously driven, rotary revolvers (66, 67, 68) having parallel axes, (b) said revolvers being sequentially arranged in tangential interface to define first and second transfer stations (73, 89) between the first and second and between the second and third revolvers, (c) a plurality of circumferentially spaced, three-sided pockets (71, 74, 91) defined in the outer periphery of each revolver, each pocket being dimensioned to closely accommodate a group (23) of cigarettes arranged in pack form with the cigarette axes parallel to the revolver axes and with the depth of each pocket substantially corresponding to the narrow width of a side face of a pack, (d) supply magazine means (35) for individually feeding groups of unwrapped cigarettes into the pockets of the first revolver, (e) means (84) adjacent the second revolver upstream from the first transfer station for individually applying inner metallic foil blanks (21) across mouths of the pockets of the second revolver, (f) stripper means (94) disposed at the first transfer station for tangentially guiding unwrapped cigarette groups from pockets of the first revolver into facing foil blank covered pockets of the second revolver while said revolvers are moving, (g) means disposed adjacent the outer periphery of the second revolver and between the first and second transfer stations for folding the foil blanks around the cigarette groups, (h) means adjacent the third revolver upstream from the second transfer station for individually applying outer paper blanks (22) across mouths of the pockets of the third revolver, and (i) means for simultaneously decreasing the radial depth of pockets of the second revolver as they pass through the second transfer station and increasing the radial depth of pockets of the third revolver to tangentially transfer foil wrapped packs from pockets of the second revolver into facing paper blank covered pockets of the third revolver while said revolvers are moving, each of said second and third revolver pockets having a radially stationary bottom (76) and radially movable side walls (77), means to respectively retract and extend said side walls in synchronism at the second transfer station such that the pocket bottoms maintain a same relative spacing at the second transfer station corresponding to the width of a side face of a pack to thereby simultaneously engage both front and rear pack faces during transfer to tangentially transfer said pack without substantial radial movement of the pack during transfer, (j) the first and third revolvers rotating in the same direction and the second revolver rotating in an opposite direction such that the cigarette groups and packs follow a sinuous path with substantially no radial movement to thereby enable a smooth and more rapid transfer.

2. Apparatus according to claim 1, wherein each pocket bottom is mounted on a radial arm (80) of a star wheel (81), and opposite side walls of a pocket are slidably mounted on a said radial arm.

3. Apparatus according to claim 2, wherein the side walls of each pocket mount a roller follower (82) cooperable with a stationary cam track (83) which form said means to retract and expand said side walls.

4. Apparatus according to claim 1, wherein the first revolver pockets have openings in side walls thereof, and the stripper means comprises a stationary arcuate bar having a sharp leading edge which enters said side wall openings.

5. Apparatus according to claim 3, wherein the first revolver pockets have openings in side walls thereof, and the stripper means comprises a stationary arcuate bar having a sharp leading edge which enters said side wall openings.

* * * * *